US005114310A

United States Patent [19]

Haavik et al.

[11] Patent Number: 5,114,310

[45] Date of Patent: May 19, 1992

[54] CENTRIFUGAL PUMP WITH SEALING MEANS

[75] Inventors: Harold Haavik, Norwalk, Conn.; Tapio Peroaho, Tavastilla, Finland; Reijo Vesala, Kotka, Finland; Vesa Vikman, Kymi, Finland

[73] Assignee: A. Ahlstrom Corporation, Noormarkku, Finland

[21] Appl. No.: 579,403

[22] Filed: Sep. 7, 1990

[51] Int. Cl.[5] ..... F01D 1/10; F01D 25/32

[52] U.S. Cl. ..... 415/169.1; 415/143; 55/203

[58] Field of Search ..... 415/169.1, 143, 110, 415/111, 115; 55/1, 52, 199, 203; 417/68; 277/70, 71, 74

[56] References Cited

U.S. PATENT DOCUMENTS

| | | | |
|---|---|---|---|
| 3,137,237 | 6/1964 | Zagar et al. | 417/171.1 |
| 4,334,830 | 6/1982 | Haavik | 417/68 |
| 4,747,752 | 5/1988 | Somarakis | 417/68 |
| 4,776,758 | 10/1988 | Gullichsen | 415/168 |
| 4,877,368 | 10/1989 | Timperi et al. | 415/143 |

*Primary Examiner*—Edward K. Look
*Assistant Examiner*—Michael S. Lee
*Attorney, Agent, or Firm*—Cohen, Pontani, Lieberman & Pavane

[57] ABSTRACT

A centrifugal pump for pumping fiber suspensions includes a centrifugal pumping housing (50) having an inlet (52) and an outlet for the suspension and a centrifugal impeller within the centrifugal pump housing. A vacuum pump (70) is placed adjacent the centrifugal pump housing (50) and includes a vacuum pump chamber defined by first and second opposed side walls (110, 112) and a vacuum pump rotor which is eccentrically mounted within the vacuum pump chamber. The rotor has radially extending opposed side edges facing the vacuum pump side walls (110, 112) forming a clearance therebetween. The pump includes a conduit within at least one of the vacuum pump side walls (110, 112) for supplying a sealing liquid to the clearance (122) between the rotor and at least one of the side walls of the vacuum pump chamber (76). Flushing liquid may be supplied through the same sealing liquid conduits or separately therefrom. The centrifugal pump may include a fluidizing impeller.

15 Claims, 4 Drawing Sheets

CENTRIFUGAL PUMP WITH SEALING MEANS

FIELD OF THE INVENTION

The present invention relates to a centrifugal pump having a built-in vacuum pump and specifically to a vacuum pump including means for supplying a sealing liquid for sealing the clearance between the vacuum pump rotor and at least one of the axially adjacent side walls of the vacuum pump chamber.

BACKGROUND AND SUMMARY OF THE INVENTION

Commercial devices which effectively handle suspensions, such as paper pulp, at medium consistency, that is at about 6–15% solids consistency, are known. It is also known that air or, more generally gas, if present in the fiber suspensions causes problems in almost all process stages in the pulp and paper industry. When pulp is pumped, mixed, screened, washed or otherwise handled without excess gas significant savings in equipment, power consumption and the like can be achieved. For instance, one device which has been particularly successful in allowing handling of gas-containing medium consistency fiber suspensions is a fluidizing centrifugal pump which simultaneously pumps and degasses the suspension. Typically, such pumps utilize a separate vacuum pump, piping from the centrifugal pump to the vacuum pump, a separate motor and motor mount for the vacuum pump, etc., in order to exhaust the gas which has been separated from the suspension so that the suspension may be effectively pumped by the pump impeller.

U.S. Pat. No. 3,230,890 discloses a centrifugal pump for removing gas from low consistency suspensions or from water having either a built-in vacuum pump or an external vacuum pump.

A fluidizing centrifugal pump having a built-in vacuum pump is disclosed in U.S. Pat. No. 4,776,758. FIG. 1 illustrates the prior art centrifugal pump, with the volute being omitted, and provided with a vacuum pump on the same shaft as the impeller. The characteristic features of the prior art pumps on the market today and which have not, however, proven to be successful due to some shortcoming in the structure thereof, are disclosed in detail in the following. The prior art pump of FIG. 1 has a fluidizing impeller 12 rotating in an ordinary medium consistency pump housing. The impeller 12 has through bores or openings 14 for allowing the air accumulated at the front side of the impeller 12 to be drawn by means of the vacuum pump 10 toward the back side of the impeller 12. The impeller is also equipped with so-called back vanes 16 on the back side thereof for separating the fiber suspension from the medium being drawn through the openings 14 in the impeller plate 18. The main purpose of the back vanes 16 is to pump the fiber suspension back to the pump volute and thus prevent the fibers from entering the vacuum pump 10, as the risk of damaging the vacuum pump 10 rises dramatically if the fibers are allowed to enter the vacuum pump 10. The vacuum pump 10 is a so-called liquid ring pump which has been arranged on the pump shaft 20 behind an intermediate plate 22 in which only a narrow ring-shaped duct 24 is provided which duct surrounds the shaft 20 or the impeller extension 26 for allowing the gas to flow towards the vacuum pump. The intermediate plate 22 is also provided with a ring-shaped channel 28 and a narrow duct 30 leading thereto for introducing make-up air to the vacuum pump while the pump is running. The duct 30 is connected via channel 32 to a vacuum regulating valve (not shown). As the flow of make-up air is not continuous and the duct is very narrow, fibers tend to accumulate therein and lead to the clogging thereof. The vacuum pump housing 34 is provided with a conduit 36 for feeding liquid to the liquid ring pump 10 for maintaining the amount of liquid substantially constant therein. Conduit 36 is connected to the outer, eccentric circumference 38 of the liquid ring pump 10. In other words, the conduit 36 leads exclusively and directly to the liquid ring. The suction opening for the liquid ring pump 10 is provided, naturally, on the side of the centrifugal impeller 12. The discharge channel (not shown) for the gas to be removed from the pump 10 is arranged at the opposite side of the vacuum pump 10, i.e. on the back side of the vacuum pump relative to the centrifugal impeller 12.

Various problems have, however, been encountered with the pump in operation today. For example, the air removal capacity has been significantly lower than required, i.e. the vacuum created has not reached a sufficiently high level. Also, the discharge pressure of the vacuum pump has been found to be too low. In some cases, it is desirable to reintroduce the material discharged from the vacuum pump, a mixture containing mainly gas but also some fibers, back into the top portion of a mass tower to recover the fibers. If, however, the discharge pressure of the vacuum pump is too low the pumped material cannot be conveyed to the top of the mass tower, and an additional pump must be installed for that purpose. Also, the open annular volume in the intermediate plate 22 of prior art pump has a tendency to become clogged by the fibers. The prior art pump also lacks any means for introducing sealing liquid between the vacuum pump rotor and the vacuum pump chamber.

The axial gap 40 in the prior art pump between the vanes 42 of the vacuum pump 10 and the inner walls 44 of the vacuum pump housing is about 0.4 mm. The reason for such large clearance is the fact that there are a number of factors that make it impossible to decrease the clearance 40 as the various components of the pump are installed on the shaft 20 or around the shaft 20 starting from the drive end 46 of the shaft. Thus, the dimensions of the components also effect the clearance 40. The result of too wide a clearance is, of course, excess leakage and an insufficient vacuum. Another reason for the wide gap 40 may also be the fact that the shaft 20 of the pump tends to flex slightly during the operation of the pump creating the risk of mechanical contact between the vacuum pump vanes 42 and the housing walls 44. Thus, the large clearance 40 is necessitated by considerations ensuring a long-lasting operation of the pump.

The pump in accordance with the present invention is designed to solve the above problems. The pump of the present invention provides means for introducing a sealing liquid to the clearances between the vacuum pump rotor and adjacent side walls for sealing the same and thus increasing the pumping action of the device. Make-up air for controlling the vacuum of the pump and for maintaining the vacuum at a constant level may be provided at the back wall of the vacuum pump chamber thereby avoiding the narrow and curved or angled make-up air ducts of the prior art pumps as well as eliminating friction factors which led to a decreased flow of make-up air.

In addition, the centrifugal pump of the present invention with the built-in rotary vacuum pump avoids the narrow flow channels of the prior art which were subject to blocking by the fibers in case the fibers entered these air ducts.

The pump is also provided with means for introducing a flushing liquid into critical locations of the instant pump so as to avoid blocking thereof by the fiber suspension.

As is described in more detail below, the sealing liquid may be introduced separately to one or both sides of the vacuum pump chamber so that it can flow into and seal the space or clearance between the pump rotor and adjacent side walls of the vacuum pump. The sealing liquid may also be fed to the spaces through a single conduit leading through the central portion of the vacuum pump rotor.

A control valve for regulating the vacuum of the vacuum pump may also be directly attached at the end of the make-up air channel.

Means are also provided to introduce a liquid into the pump for replenishing the liquid ring which is partially exhausted with the air during rotation. Finally, the vacuum pump rotor central portion may be tapered toward the gas outlet ports so as to prevent the formation of a gas pocket around the rotor central portion.

The centrifugal pump impeller may be provided with a rotor having fluidizing blades either within the pump inlet or entirely outside the pump inlet or any combination thereof.

The pump is utilized for pumping gas containing media such as filtrates from industrial filtering devices and fiber suspensions in the pump and paper industry which may also contain substantial amounts of gas.

DETAILED DESCRIPTION OF THE PRESENTLY PREFERRED EMBODIMENTS

Figure 1:
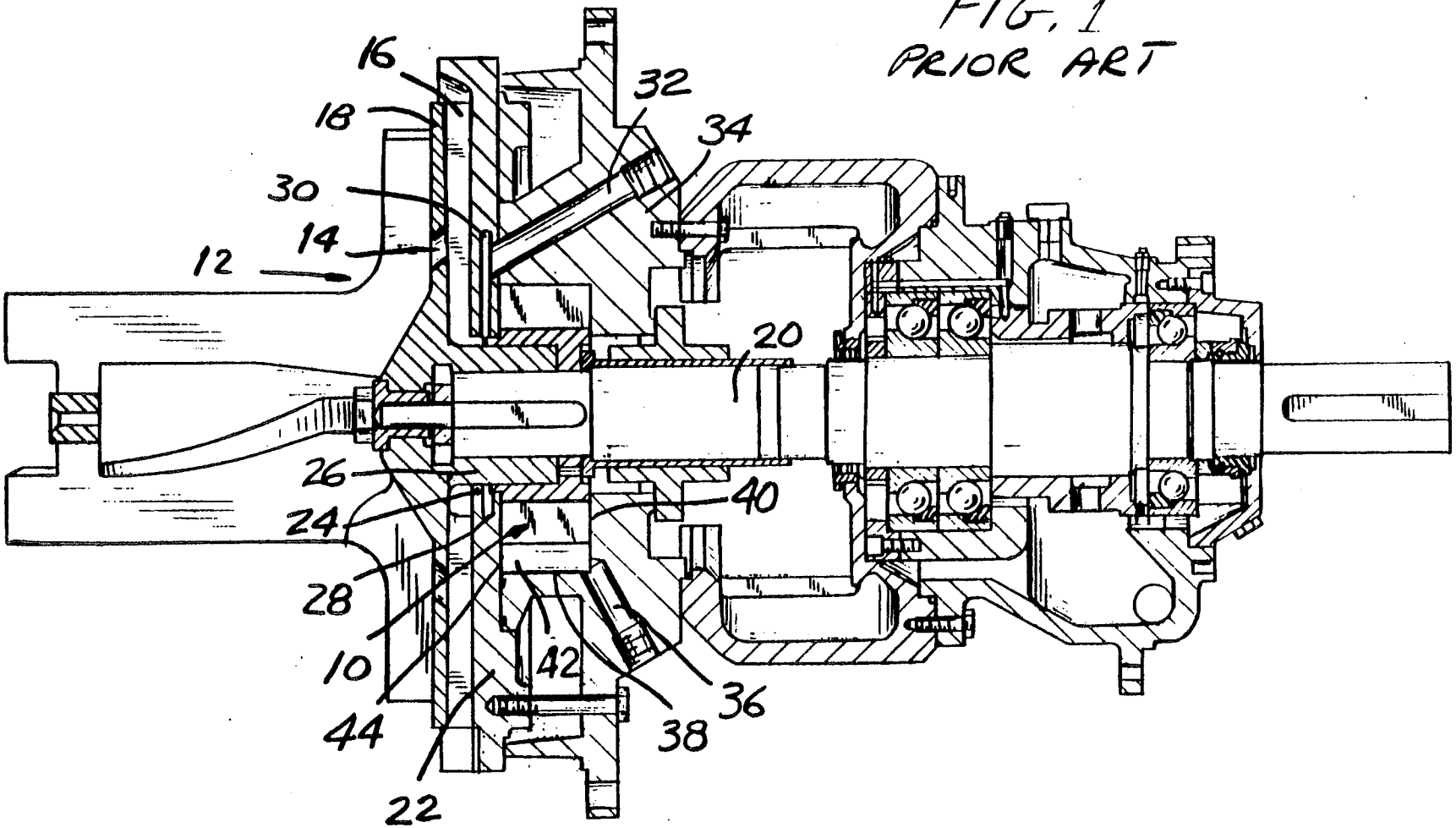
FIG. 1 PRIOR ART
FIG. 1 is a partial vertical cross-sectional view of an exemplary prior art pump with the conventional pump housing not shown.
Figure 2:
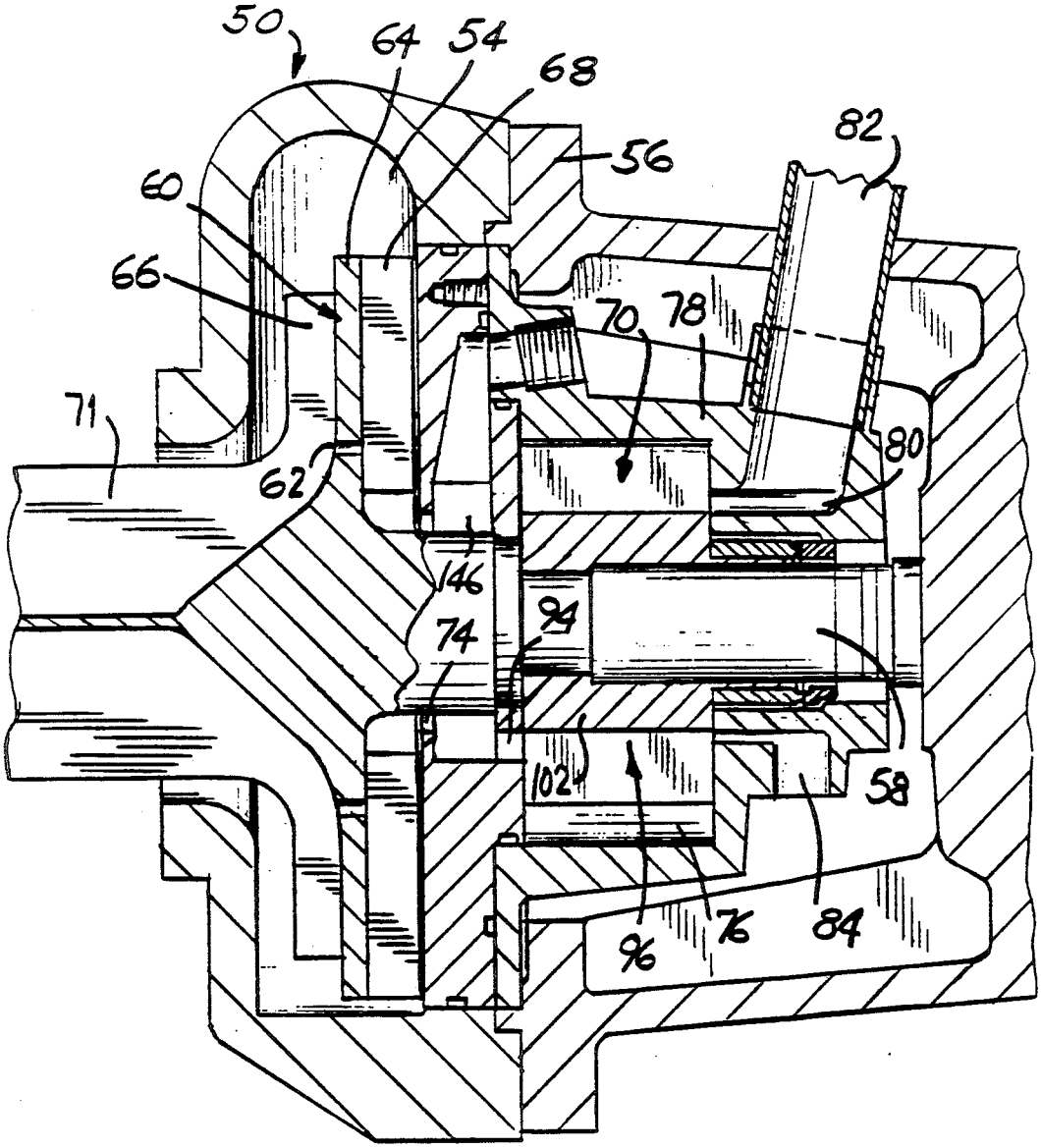
FIG. 2 is a partial vertical cross-sectional view of a first preferred embodiment of a centrifugal pump in accordance with the present invention.
Figure 3:
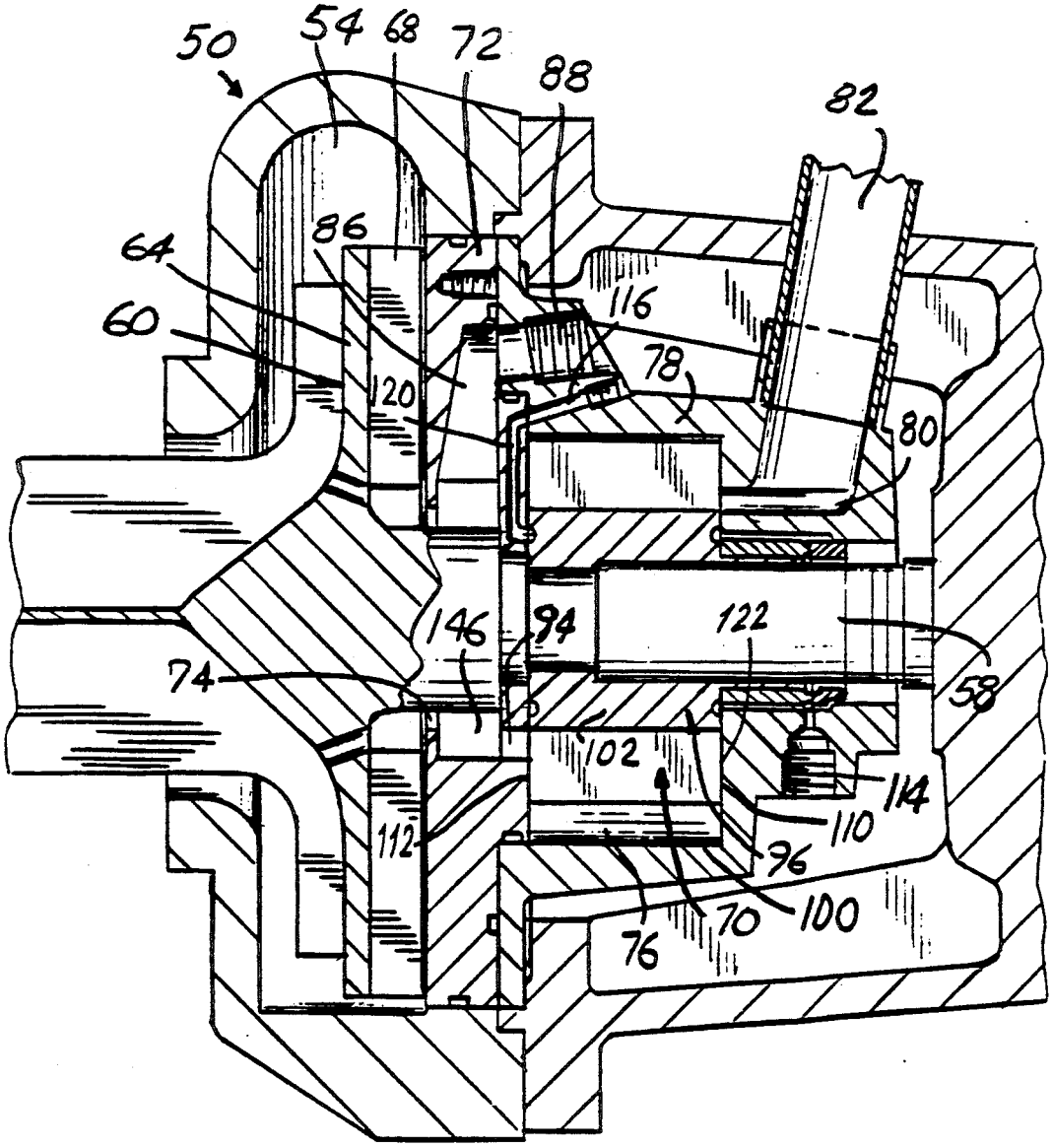
FIG. 3 is a partial vertical cross-sectional view of a second preferred embodiment of a centrifugal pump in accordance with the present invention.
Figure 4:
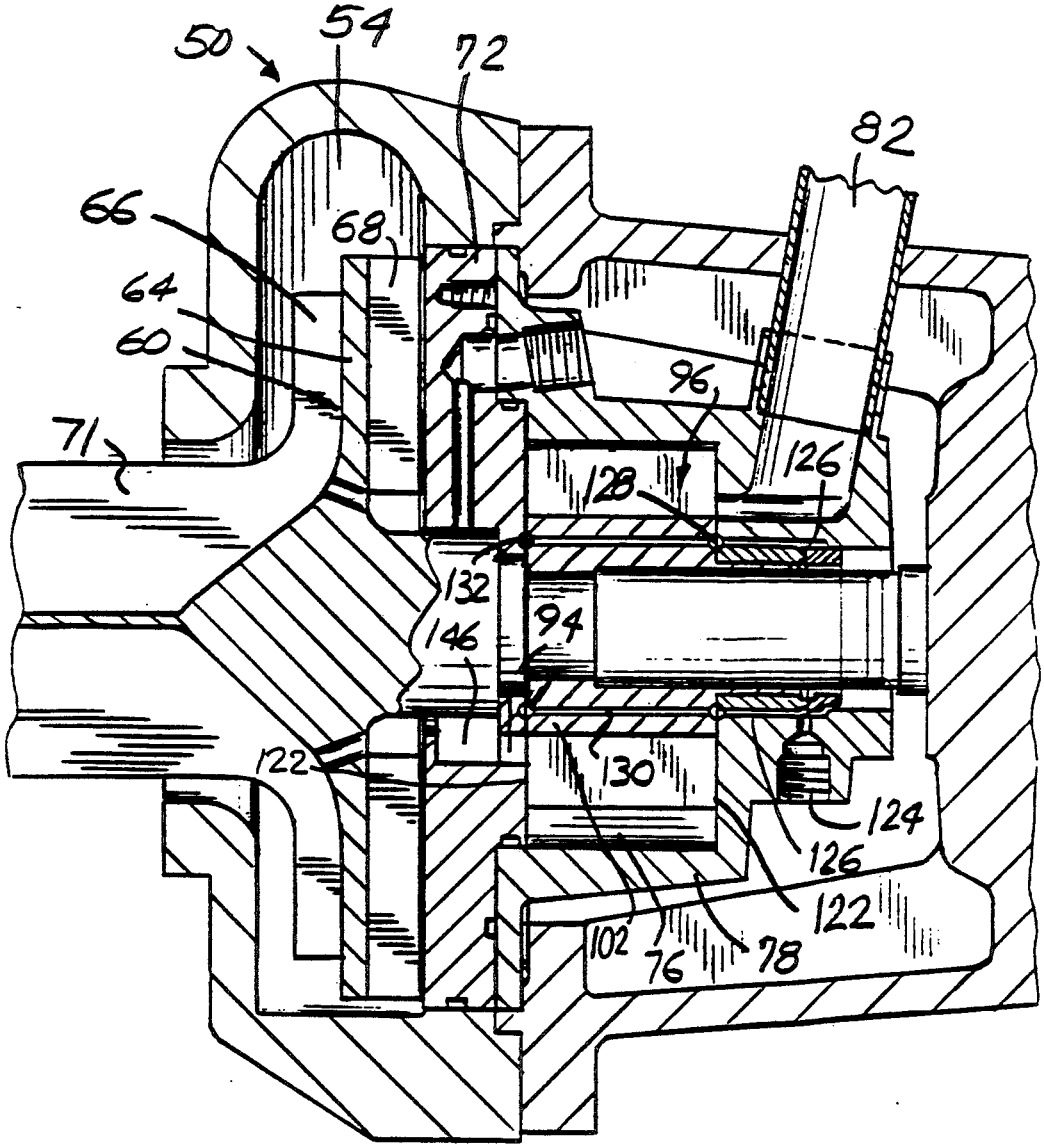
FIG. 4 is a partial vertical cross-sectional view of a further preferred embodiment of the pump of the present invention.

FIGS. 2-4 show a partial cross sectional view of the centrifugal pump in accordance with the present invention. The pump has a housing 50 including an inlet channel 52 for medium consistency fiber suspension and a volute 54. The housing 50 is attached to the pump frame 56 having at one end thereof the bearing assembly (not shown) for supporting the pump shaft 58 at the end of which the centrifugal impeller 60 having openings 62 in its back plate 64 is mounted. The centrifugal impeller 60 is further provided with front vanes, i.e. working vanes 66, on the front side and with back vanes 68 on the opposite side of the back plate 64. A rotor having fluidizing blades 71 may be mounted on the shaft 58 in front of the impeller 60 in case fiber suspensions of medium or high consistency are pumped. The fluidizing blades may extend through the pump inlet 52 or be located only outside the inlet and within the pulp containing vessel. Located between the bearing unit and the centrifugal impeller 60 is the sealing assembly (not shown). Between the sealing assembly and the centrifugal impeller 60 there is mounted a vacuum pump 70 on the same shaft 58 as the centrifugal impeller 60. The vacuum pump 70 is separated from the volute 54, i.e. from the space housing the centrifugal impeller 60, by means of an intermediate plate 72 which also forms the head of the vacuum pump 70. In this embodiment plate 72 has a central annular opening 74 for the shaft 58 and for permitting the gas to flow from the space behind the centrifugal impeller 60 to the vacuum pump 70. The vacuum pump chamber 76 is arranged within a vacuum pump housing 78. The vacuum pump 70 is a so-called liquid ring pump with an eccentric chamber 76 relative to the rotor 96. The vacuum pump housing 78 has, in addition to the eccentric chamber 76, a discharge port or pipe 80 for the gas at the pressure side of the chamber 76 (the upper side in FIG. 2) and leading to a gas discharge connection 82 on the outer surface of said housing. The housing 78 further has an additional air duct 84 leading to the eccentric chamber 76 at its suction side (the lower side in the drawing) and at the back side of the vacuum pump chamber relative to its front side facing the head or intermediate plate 72. Duct 84 is for providing control or make-up air to the vacuum pump 70, i.e. for controlling the vacuum of the pump and for maintaining the vacuum at a constant level. It is to be noted that air duct 84 is dimensioned with respect to its diameter and length so that the vacuum pump 70 will readily receive additional air in case there is insufficient air flowing from the material to be pumped. A control valve (not shown) for regulating the vacuum of the vacuum pump may be directly attached to the end of the make-up air duct.

In accordance with one embodiment of the present invention, FIG. 3 shows the vacuum pump housing 78 provided with two connections or ports 114, 116 located on opposite sides of the vacuum pump chamber 76 for introducing sealing liquid via ducts 118, 120 to both sides of the vacuum pump rotor 96 including the central portion and vanes thereof for sealing the clearance 122 between the vacuum pump rotor 96 and side walls 110, 112 of the eccentric vacuum chamber 76. Preferably, the sealing liquid, such as water, is fed to the vicinity of the rotor central portion, i.e. at or around central portion 102 of vacuum pump rotor 96 so as to begin sealing the portion closest to shaft 58. The sealing liquid is thereafter carried radially outwardly and along the rotor blade side edges by centrifugal forces during the operation of the vacuum pump. In addition, by feeding sealing liquid to the inner portion of the vacuum pump chamber 76, the pressure in the pump is prevented from escaping from the spaces between the vacuum pump vanes 98 resulting in the vacuum and also in the discharge pressure in the outlet 82 being significantly higher. As stated, in the embodiment shown in FIG. 3, a first sealing liquid inlet 114 is provided at the discharge side of the vacuum pump (in FIG. 3 the right hand side of the pump). Conduit 118 which extends between the packing and the vacuum pump housing substantially parallel to shaft 58 connects the vacuum pump chamber with liquid inlet port 114. Preferably, the sealing liquid inlet into the vacuum pump chamber 76 through either one or both of the side walls of the vacuum pump is located in close proximity to the pump shaft 58 so that the sealing liquid will be supplied to the clearance 122 in the region of the central rotor portion 102 and the side wall 110, 112 of the vacuum pump housing 78.

To supply the clearance 112 at the opposite side between the pump rotor 96 and intermediate wall 72, with sealing liquid an additional sealing liquid inlet port and associated conduit 116 is provided extending through the vacuum pump housing 78 and intermediate wall 72. The sealing liquid is again supplied through conduit 116 directly to the suction side or left hand side of the vacuum pump and optionally through a further channel (not shown) surrounding shaft 58 and which is preferably, but not necessarily circular to the lower or opposite side of the shaft. This way, sealing liquid, such as water is supplied to both sides of the vacuum pump rotor thereby markedly increasing the pumping action thereof. It is to be noted that the sealing liquid will also seal the entire clearance between the radial length of the vanes 98 of the vacuum pump rotor and the side walls 110 and 112 of the vacuum chamber 76 as the centrifugal force acting on the sealing liquid together with the feed pressure will force the sealing liquid to flow along the vanes 98 in an outward direction. Thus, the sealing liquid inlet port is preferably located somewhere between the shaft and the surface of the rotary liquid ring.

In the embodiment shown in FIG. 4, the sealing liquid is fed to both sides of the vacuum pump by using only one inlet port 124. The inlet port 124 is located in the vacuum pump housing 78 adjacent the right hand side of the eccentric vacuum pump chamber 76. It is understood that the mentioned eccentricity is caused by the rotor being mounted at a position eccentric relative to the pump chamber as is necessary in liquid-ring pumps of the type described herein.

Sealing liquid inlet port 124 is connected to conduit or duct 126 which guides the sealing liquid into the clearance between the vacuum pump rotor 96 and the vacuum pump side wall 110. As shown in FIG. 4 conduit 126 leads from inlet port 124 to a circular groove 128 within the vacuum pump rotor central portion 102 and through at least one throughbore 130 in said central portion 102 to preferably a second groove 132 at the opposite end of the vacuum pump rotor central portion 102. This way only one port 124 for the introduction of sealing liquid is required. It is understood that groove 128 and optional groove 132 can also be located only in the vacuum pump chamber side walls or that grooves may be provided in both the side walls and the rotor central portion as shown.

It is to be noted that mechanical sealing means may also be used such as, for example, gliding sealings or labyrinth seals.

Since these as well as further embodiments and modifications thereto are intended to be within the scope of the present invention, the above description should be construed as illustrative and not in a limiting sense, the scope of the invention being defined solely by the appended claims.

What is claimed is:

1. A centrifugal pump for pumping a gas-containing medium comprising:

a centrifugal pumping housing (50) having an inlet (52) and an outlet for said medium;

a centrifugal impeller (60) within said centrifugal pumping housing (50);

a liquid ring vacuum pump (70) adjacent said centrifugal pumping housing (50), said vacuum pump including a vacuum pump chamber (76) defined by first and second opposed side walls (112, 110) spaced apart by a circumferential annular wall (100);

a vacuum pump rotor eccentrically positioned within said vacuum pump chamber (76), said rotor having a central portion (102) carrying a plurality of blades with outwardly extending opposed side edges facing said vacuum pump side walls (112, 110) and forming a clearance therebetween;

a rotary shaft (58) extending through said vacuum pump chamber and into said centrifugal pump housing (50); said central portion (102) having an outer surface defined radially outwardly from said rotary shaft (58);

said centrifugal pump impeller and said vacuum pump rotor being mounted on said shaft in spaced relation to each other; and means within at least one of said vacuum pump side walls (112, 110) for supplying a sealing liquid to said clearance (122) between said rotor central portion (102) and at least one of said side walls (112, 110) of said vacuum pump chamber (76) at a location between said central portion outer surface and said rotary shaft (58).

2. The pump according to claim 1, wherein said rotor central portion (102) is disposed circumjacent said shaft (58) and comprises opposite ends adjacent said side walls (110, 112); and said means for supplying a sealing liquid comprises at least one conduit (118, 120) leading to said vacuum pump chamber (76) and communicating with said clearance (122) between at least one of said opposite ends of the rotor central portion (102) and said vacuum pump side wall (110, 112).

3. The centrifugal pump as claimed in claim 1, additionally comprising an intermediate wall (72, 112) separating said centrifugal impeller (60) from said vacuum pump impeller (96) and said means for supplying said sealing liquid comprises a first sealing liquid conduit (118) extending through said side wall (110) and a second sealing liquid conduit (120) extending through said intermediate wall (72, 112) to said vacuum pump chamber (76).

4. The centrifugal pump as claimed in claim 2, wherein said means for supplying said sealing liquid comprises a single sealing liquid inlet port (124) and a conduit (126, 127) connected to said inlet port (124); said vacuum pump rotor (96) comprising two lateral ends, and at least one throughbore (130) through said central portion and in communication with said clearance (122) between said rotor and said first and second opposed side walls (110, 112); said conduit (126) being in communication with at least one of said opposed side walls (110) and said throughbore (130) for supplying sealing liquid to said clearance (122) between said rotor and both said second and first opposed side walls (110, 112).

5. The centrifugal pump as claimed in claim 4, wherein said central portion (102) of said vacuum pump rotor (96) comprises a first circular groove (128) extending along said one lateral end of said rotor, said first groove (128) communicating with said sealing liquid supplying means.

6. The centrifugal pump as claimed in claim 5, wherein said circular groove additionally communicates with said at least one throughbore (130) within said rotor central portion (102).

7. The centrifugal pump as claimed in claim 5, additionally comprising a second circular groove (132) extending along said other lateral end of said rotor and communicating with said at least one throughbore (130) within said rotor central portion (102) opposite said first circular groove (128) and facing said side wall (112).

8. The centrifugal pump as claimed in claim 2, wherein at least one of said side walls (110, 112) comprises a circular groove (128) facing said one end of said rotor, said groove (128) communicating with said sealing liquid supplying means.

9. The centrifugal pump as claimed in claims 4 additionally comprising a circular groove within at least one of said side walls and in communication with said at least one throughbore (130) within said rotor central portion (102).

10. The centrifugal pump as claimed in claim 9, additionally comprising a second circular groove (132) extending along said other side wall (112) facing said other end of said rotor and communicating with said at least one throughbore (130) within said rotor central portion (102) opposite said first circular groove (128).

11. The centrifugal pump as claimed in claim 1, additionally comprising means for supplying flushing liquid to said vacuum pump for removing said fiber suspension therefrom.

12. The centrifugal pump as claimed in claim 11, wherein said flushing liquid supply means comprises an intermediate wall (72) separating said centrifugal impeller (60) from said vacuum impeller (96), and a liquid inlet duct (86, 88) for feeding liquid to said vacuum pump (70), said liquid inlet duct (86) extending within said intermediate wall (72) and communicating with said chamber (76) of said vacuum pump (70).

13. The centrifugal pump as claimed in claim 1, additionally comprising a fluidizing impeller for fluidizing a fiber suspension mounted on said shaft in front of said centrifugal impeller (60).

14. The centrifugal pump as claimed in claim 13, wherein said fluidizing impeller is located outside said pump inlet.

15. The centrifugal pump as claimed in claim 1, wherein said vacuum pump chamber (76) has a pressure side and a suction side and additionally comprising a gas discharge opening (80) at said pressure side of said chamber (76); a gas inlet port (94) at said suction side communicating with said centrifugal pumping housing; and a make-up air inlet duct (84) in said rear wall of said chamber (76) opposite said air inlet port (94).

* * * * *